US009266585B2

(12) United States Patent
Ortego

(10) Patent No.: US 9,266,585 B2
(45) Date of Patent: Feb. 23, 2016

(54) PEDESTAL SEAT GEAR BAG AND BRACKET SYSTEM

(71) Applicant: Michael Ortego, Oviedo, FL (US)

(72) Inventor: Michael Ortego, Oviedo, FL (US)

( * ) Notice: Subject to any disclaimer, the term of this patent is extended or adjusted under 35 U.S.C. 154(b) by 0 days.

(21) Appl. No.: 14/108,334

(22) Filed: Dec. 16, 2013

(65) Prior Publication Data

US 2015/0360754 A1 Dec. 17, 2015

(51) Int. Cl.
*B63B 29/04* (2006.01)
*B63B 69/00* (2013.01)

(52) U.S. Cl.
CPC ..... *B63B 29/04* (2013.01); *B63B 69/00* (2013.01); *B63B 2029/043* (2013.01)

(58) Field of Classification Search
CPC ..... B63B 29/04; B63B 69/00
USPC ..... 297/188.08, 188.09, 188.12
See application file for complete search history.

(56) References Cited

U.S. PATENT DOCUMENTS 4,745,704 A * 5/1988 Schaefer ..... A45C 5/00 297/188
5,481,822 A * 1/1996 Engels ..... A01K 97/06 297/188.12 X
7,901,000 B1 * 3/2011 Sorensen ..... A47C 7/62 397/188.08
8,708,407 B2 * 4/2014 Marino ..... A47C 9/10 297/188.08 X

* cited by examiner

*Primary Examiner* — Anthony D Barfield
(74) *Attorney, Agent, or Firm* — Ruben Alcoba, Esq.

(57) ABSTRACT

A pedestal seat gear bag system that is installed between a pedestal seat and a pedestal seat post, the bag system comprises of a spacer that is attached to the seat. The invention is further comprised of a circular mounting bracket that is attached to the spacer and to the pedestal seat post. And lastly, the invention is further comprised of a bag system that is attached to the circular mounting bracket so that the bag system drapes over the circumference of the circular mounting bracket, the bag system defines a plurality of pockets.

5 Claims, 3 Drawing Sheets

PEDESTAL SEAT GEAR BAG AND BRACKET SYSTEM

CROSS REFERENCE

The present application is a continuation of my provisional application, the application having Ser. No. 61/737,198, filed on Dec. 14, 2012, titled "Pedestal Seat Gear Bag and Bracket." The application is incorporated herein by this reference which is not admitted to be prior art with respect to the present invention by its mention in the background.

BACKGROUND

The present invention is directed to a gear bag that is used on marine vessels to maximize deck space, maximize accessibility to equipment and to reduce the possibility of on-board accidents.

The inventor is an avid boater that has studied the hazards caused by the placement of storage bags in the limited amount of space that is available in small to medium sized recreational and commercial fishing vessels.

The inventor has also studied the available spaces in a small to medium sized fishing vessels. What he realized during his studies was that there was one space that allowed for a gear bag to be placed that would not minimize the amount space available on a boat and that would not cause a hazard by its placement. The space was directly under the seat of the boat pedestal seats on fishing vessels.

For the foregoing reasons, there is a need for a seat gear bag system and bracket that can be placed on boat seat pedestals that will maximize the space on a fishing vessel and that will not be a hazard.

SUMMARY

The present invention is directed to a seat gear bag system and bracket that can be placed on boat seat pedestals that will maximize the space on a fishing vessel and that will not be a hazard.

The present invention is a pedestal seat gear bag system that is installed between a pedestal seat and a pedestal seat post, the bag system comprises of a spacer that is attached to the seat. The invention is further comprised of a circular mounting bracket that is attached to the spacer and to the pedestal seat post. And lastly, the invention is further comprised of a bag system that is attached to the circular mounting bracket so that the bag system drapes over the circumference of the circular mounting bracket, the bag system defines a plurality of pockets.

An object of the present invention is to maximize the space on a small to medium sized fishing vessel.

Another object of the present invention is to minimize the hazards on a small to medium fishing vessel due to the placement of gear bags on the vessel.

DRAWINGS

These and other features, aspects, and advantages of the present invention will become better understood with regard to the following description, appended claims, and drawings where:

DESCRIPTION

Figure 1:
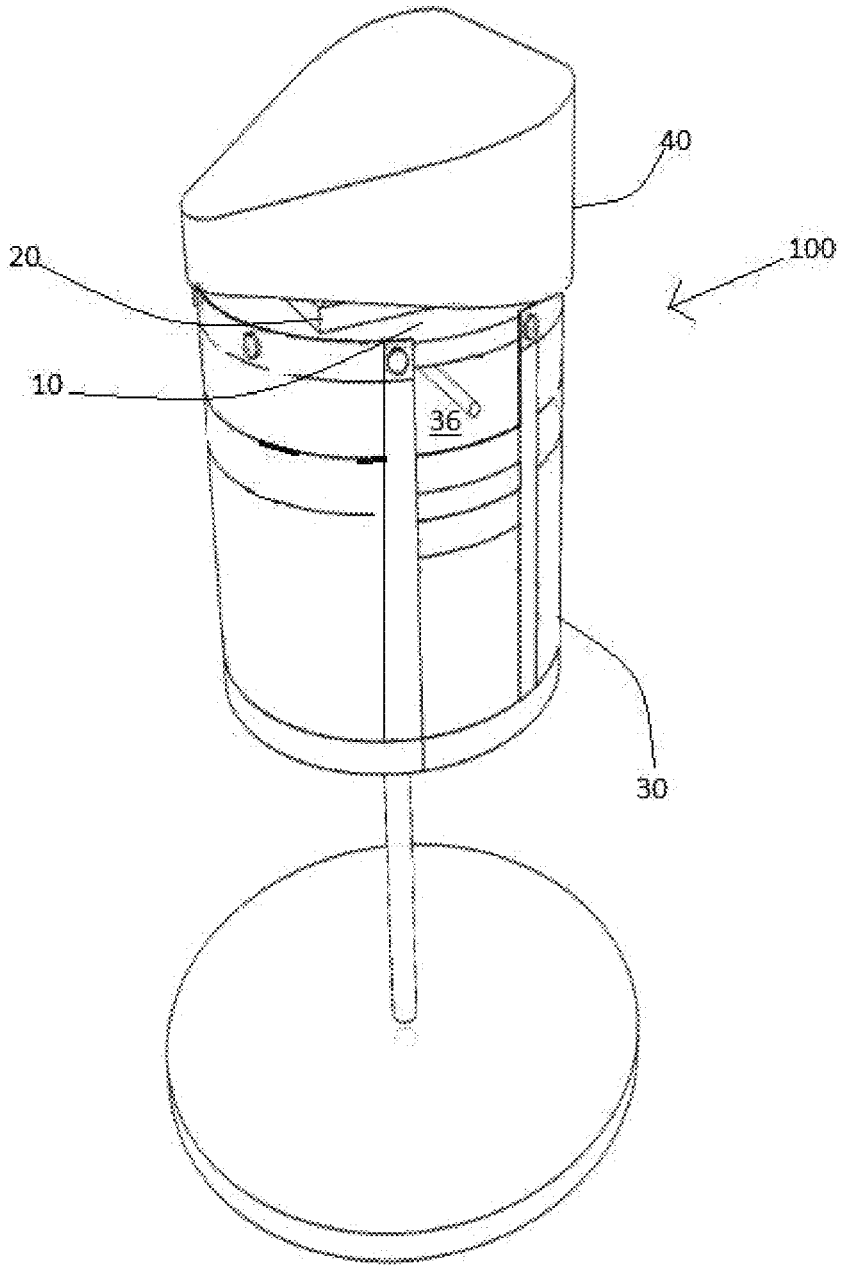
FIG. 1 is a perspective view of the present invention showing an embodiment of the present invention.
Figure 2:
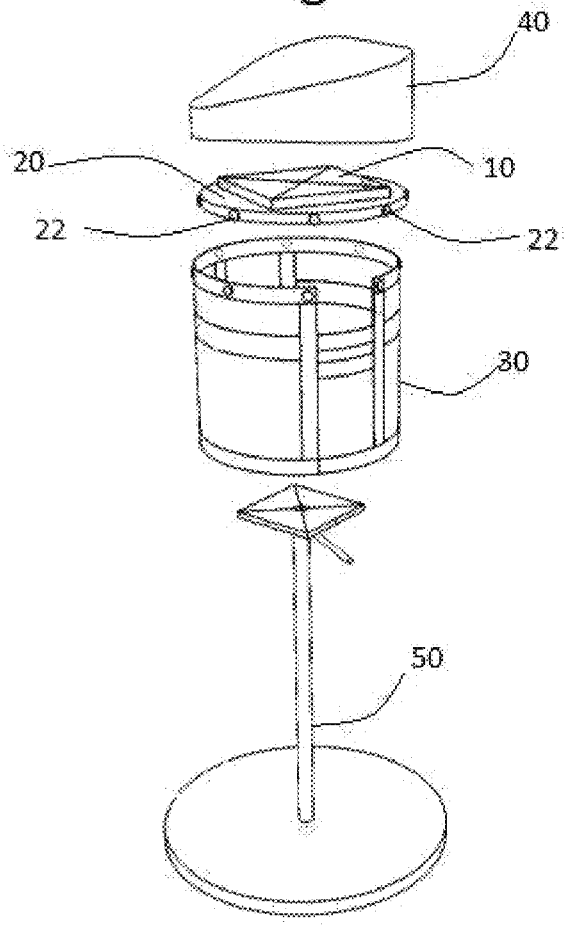
FIG. 2 is a perspective view of the present invention, wherein each element of the present invention is separated.
Figure 3:
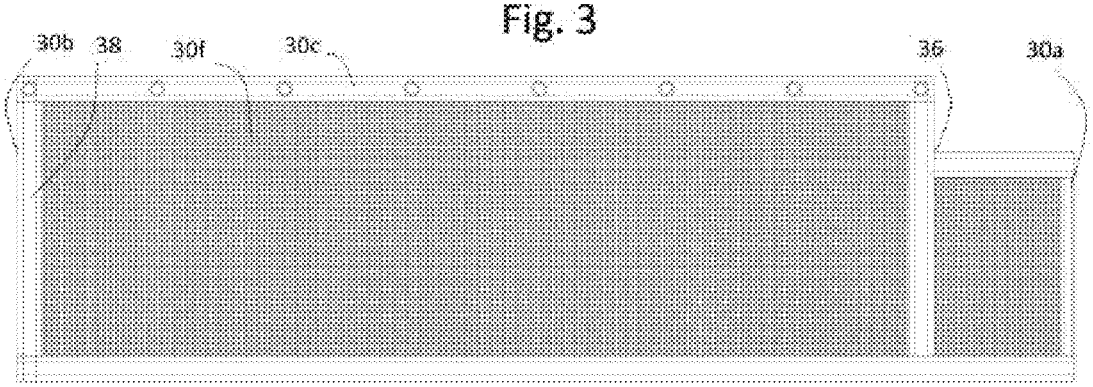
FIG. 3 is a rear view of the bag system of the present invention is shown.
Figure 4:
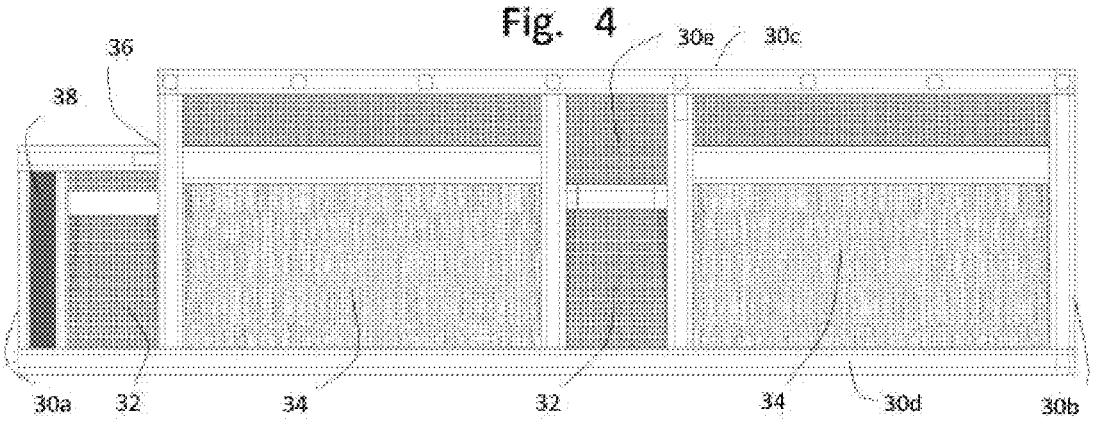
FIG. 4 is a front view of the bag system showing the placement of the pockets.

As seen in FIGS. 1-4, the present invention is a pedestal seat gear bag system 100 that is installed between a pedestal seat 40 and a pedestal seat post 50, the bag system 100 comprises: a spacer 10 that is attached to the seat 40; a circular mounting bracket 20 that is attached to the spacer 10 and to the pedestal seat post 50; and a bag system 30 that is attached to the circular mounting bracket 20 so that the bag system 30 drapes over the circumference of the circular mounting bracket 20, the bag system 30 defines a plurality of pockets 32,34.

In an embodiment of the present invention the spacer 10 is an eight inch by eight inch square that defines a plurality of slots that are pre-arranged to fit existing pedestal seat posts 50.

In another embodiment of the present invention, the circular mounting bracket 20 has at-least a twelve inch diameter and is at-least one half an inch thick, and a plurality of snap studs 22 are attached and spaced apart along the circumference of the circular mounting bracket 20.

In a further embodiment of the present invention, the bag system 30 is a rectangular bag 30 having a length of forty three inches and a height of twelve inches that has a left 30*a*, a right side 30*b*, a top 30*c*, a bottom 30*d*, a front 30*e*, and a rear side 30*f*, and two of the plurality of pockets have a length of sixteen inches 34 and two of the plurality of pockets have a length of five inches 32, the pockets 32,34 are staggered so that every pocket of sixteen inches is bordered by a pocket of five inches, the bag system 30 further defines a hook and loop attachment means 38, the hook and loop attachment means 38 comprises of a pair of hook and loop strips 38 that run along the height of the rectangular bag 30, one of the strips 38 is adjacent to the left 30*a* and one of the strips 38 is adjacent to the right side 30*b* of the rectangular bag 30, the strips 38 are positioned so that one strip 38 is positioned on the front side 30*e* and the other strip 38 is on the back side 30*f* of the rectangular bag 30, and a plurality of snap sockets 39 that attach to the plurality of snap studs 22.

In preferred embodiments of the present invention, the bag system 100 is made of a combination of coated mesh, polyester mesh, polypropylene webbing, woven elastic, and ultraviolet bonded ninety two thread.

In yet another embodiment of the present invention, the rectangular bag 30 defines a rectangular cutout 36 along the top 30*c* of the rectangular bag 30 at a position above one of the pockets that has a length of five inches.

In a preferred embodiment of the present invention the spacer size is 8" by 8" and is made of ¾" Starboard with universal slots cut in it to fit majority of pedestal seats bolt layouts. The size is preferred for it allows for clearance between the circular mounting bracket and the bottom of the seat allowing for easy installation of the snaps on the bags.

In an preferred embodiment, the diameter of the circular mounting bracket is 13" is made of ¾" Starboard with Universal slots cut in it to fit majority of pedestal seats bolt layouts and matching those slots in the spacer. The Bracket plate has 8 stainless steel snap studs installed along the outer edge in specific locations allowing for the bag to be installed by snapping around the circumference of the mounting bracket in a draping manner. The size of this mounting bracket allows for 360 degree rotation with the seat and minimizes and interference to the legs of the user or impeding into limited deck space.

In a preferred embodiment, the bag system is 43" in length and 12" in height and is designed with 4 pockets, 2 utility and 2 large capacity pockets. These pockets are designed to be installed by snapping its 8 snaps along the upper edge of the bag to the circular mounting bracket in a cylindrical shape and using hook & loop at both ends to over-lap and secure the ends together. The installation of the bag is designed so that the 2 utility pockets end up at the sides of the seat and the large capacity pockets to be aligned squarely in the front and the back of the pedestal seats. There is an access window in the design of the bag allowing access to the lever of the pedestal seat post which allows for adjustment up and down of the seat. 4" hook & loop strips are sewn into the pocket opening for secured closure of the large capacity pockets.

Some embodiments of the present invention use the following items or materials: 1. Stainless Steel Snaps and studs; 2. Starboard for bracket and spacer; 3. Coated Mesh for backing and Utility pockets; 4. Elastic webbing for the large capacity pocket openings; 5. Hook & Loop for securing the large capacity pocket opening closed; 6. Poly Propylene Webbing for the trim; and 7. Hook and loop at both ends of the bag for securing both ends together creating the cylinder shape of the bag when installed.

An advantage of the present invention is that it maximizes the space on a small to medium sized fishing vessel.

Another advantage of the present invention is that it minimizes the hazards on a small to medium sized fishing vessel due to the placement of gear bags on the vessel.

While the inventor's above description contains many specificities, these should not be construed as limitations on the scope, but rather as an exemplification of several preferred embodiments thereof. Many other variations are possible. Accordingly, the scope should be determined not by the embodiments illustrated, but by the appended claims and their legal equivalents.

What is claimed is:

1. A pedestal seat gear bag system that is installed between a pedestal seat and a pedestal seat post, the bag system comprises:

a spacer that is attached to the seat;

a circular mounting bracket that is attached to the spacer and to the pedestal seat post; and a bag system that is attached to the circular mounting bracket so that the bag system drapes over the circumference of the circular mounting bracket, the bag system defines a plurality of pockets, wherein the spacer is an eight inch by eight inch square that defines a plurality of slots that are pre-arranged to fit existing pedestal seat posts.

2. The pedestal seat gear bag system of claim 1, wherein the circular mounting bracket has at-least a twelve inch diameter and is at-least one half an inch thick, and a plurality of snap studs are attached and spaced apart along the circumference of the circular mounting bracket.

3. The pedestal seat gear bag system of claim 2, wherein the bag system is a rectangular bag having a length of forty three inches and a height of twelve inches that has a left, a right side, a top, a bottom, a front, and a rear side, and two of the plurality of pockets have a length of sixteen inches and two of the plurality of pockets have a length of five inches, the pockets are staggered so that every pocket of sixteen inches is bordered by a pocket of five inches, the bag system further defines a hook and loop attachment means, the hook and loop attachment means comprises of a pair of hook and loop strips that runs along the height of the rectangular bag, one of the strips is adjacent to the left and one of the strips is adjacent to the right side of the rectangular bag, the strips are positioned so that one strip is positioned on the front side and the other strip is on the back side of the rectangular bag, and a plurality of snap sockets that attach to the plurality of snap studs.

4. The pedestal seat gear bag system of claim 3, wherein the bag system is made of a combination of coated mesh, polyester mesh, poly propylene webbing, woven elastic, and ultraviolet bonded ninety two thread.

5. The pedestal eat gear bag system of claim 4, wherein the rectangular bag defines a rectangular cutout along the top of the rectangular bag at a position above one of the pockets that has a length of five inches.

* * * * *